US011034049B2

(12) United States Patent
Neuer

(10) Patent No.: US 11,034,049 B2
(45) Date of Patent: Jun. 15, 2021

(54) KINETIC LOG SPLITTER HAVING AUTOMATIC BRAKE MECHANISM

(71) Applicant: QV Tools Limited Liability Company, Las Vegas, NV (US)

(72) Inventor: Gregory D. Neuer, Las Vegas, NV (US)

(73) Assignee: QV Tools Limited Liability Company, Las Vegas, NV (US)

( * ) Notice: Subject to any disclaimer, the term of this patent is extended or adjusted under 35 U.S.C. 154(b) by 122 days.

(21) Appl. No.: 16/379,358

(22) Filed: Apr. 9, 2019

(65) Prior Publication Data

US 2019/0344468 A1 Nov. 14, 2019

Related U.S. Application Data

(60) Provisional application No. 62/669,219, filed on May 9, 2018.

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06; B27L 7/08
See application file for complete search history.

(56) References Cited

U.S. PATENT DOCUMENTS

| | | | | |
|---|---|---|---|---|
| 4,116,251 | A * | 9/1978 | Graney | B27L 7/00 144/193.1 |
| 4,258,764 | A * | 3/1981 | Gerst | B27L 7/00 144/193.1 |
| 9,649,777 | B2 * | 5/2017 | Foley | B27L 7/00 |
| 9,919,450 | B2 * | 3/2018 | Hu | B27L 7/00 |
| 10,272,591 | B2 * | 4/2019 | Foley | B27L 7/06 |
| 2013/0000785 | A1 * | 1/2013 | Banjo | B27L 7/00 144/366 |
| 2015/0328798 | A1 * | 11/2015 | Miller | B27G 21/00 144/195.8 |

FOREIGN PATENT DOCUMENTS

CN 108247793 A 7/2018

* cited by examiner

*Primary Examiner* — Matthew Katcoff
(74) *Attorney, Agent, or Firm* — Dinsmore & Shohl LLP

(57) ABSTRACT

A kinetic log splitter includes a frame, a splitter, a gear shaft, a drive assembly, a push plate, a rack, and an automatic brake mechanism. The splitter is coupled to the frame. The gear shaft rotatably coupled to the frame. The drive assembly configured to rotate the gear shaft. The push plate is slidably coupled to the frame. The rack is operatively coupled to the push plate. The rack is configured to engage with the gear shaft to linearly displace the push plate towards the splitter. The an automatic brake mechanism is configured to automatically inhibit rotation of the gear shaft by the drive assembly upon exceeding a predetermined tonnage on the push plate.

19 Claims, 4 Drawing Sheets

KINETIC LOG SPLITTER HAVING AUTOMATIC BRAKE MECHANISM

CROSS-REFERENCE TO RELATED APPLICATIONS

The present specification claims priority to U.S. Provisional Patent Application No. 62/669,219, filed May 9, 2018.

TECHNICAL FIELD

The present specification generally relates to log splitters, and more particularly, kinetic log splitters having automatic brake mechanisms.

BACKGROUND

It has been known to provide log splitters that split logs into smaller pieces for convenience. The previously known log splitters utilize kinetic energy stored in a flywheel to linearly displace a ram towards a stationary splitter. The log is placed between the ram and the stationary splitter. A motor rotates a flywheel operatively connected to a gear shaft such that rotation of the flywheel rotates the gear shaft. The ram includes a plurality of teeth that engages with gear teeth of the rack to linearly displace the ram forward towards the splitter. However, in the previously known log splitters, the gear shaft continues to rotate due to the rotation of the flywheel by the motor even when the linear displacement of the ram is stopped or jammed.

As such, the continued rotation gear shaft, when the ram is stopped, leads to a decrease is useful life of the ram and the gear shaft. Specifically, once the ram is inhibited from linearly displacing forward, the gear shaft continues to rotate with the gear teeth engaged with the plurality of teeth of the ram thereby causing wear and/or damage to the plurality of teeth of the ram and the gear teeth of the gear shaft.

Accordingly, there is a need for a kinetic log splitter having an automatic braking mechanism which is configured to inhibit rotation of the gear shaft upon stopping of the forward linearly displacement of the ram towards the stationary splitter.

SUMMARY

In one embodiment, a kinetic log splitter includes a frame, a splitter, a gear shaft, a drive assembly, a push plate, a rack, and an automatic brake mechanism. The splitter is coupled to the frame. The gear shaft is rotatably coupled to the frame. The drive assembly is configured to rotate the gear shaft. The push plate is slidably coupled to the frame. The rack is operatively coupled to the push plate. The rack is configured to engage with the gear shaft to linearly displace the push plate towards the splitter. The automatic brake mechanism is configured to automatically inhibit rotation of the gear shaft by the drive assembly upon application of a pressure/tonnage or force that exceeds a predetermined tonnage on the push plate.

In another embodiment, a kinetic log splitter includes a frame, a splitter, a gear shaft, a motor, a flywheel, a push plate, a rack, and a slip disk assembly. The splitter is coupled to the frame. The gear shaft is rotatably coupled to the frame. The motor is configured to rotate an output shaft. The flywheel is operatively coupled to the output shaft of the motor. The push plate is slidably coupled to the frame. The rack is operatively coupled to the push plate. The rack is configured to engage with the gear shaft to linearly displace the push plate towards the splitter. The slip disk assembly is configured operatively couple the flywheel to the gear shaft so as to transmit rotational force from the flywheel to the gear shaft. The slip disk assembly is configured to automatically inhibit rotation of the gear shaft by the flywheel upon exceeding a predetermined rotational force between the flywheel and the slip disk assembly.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
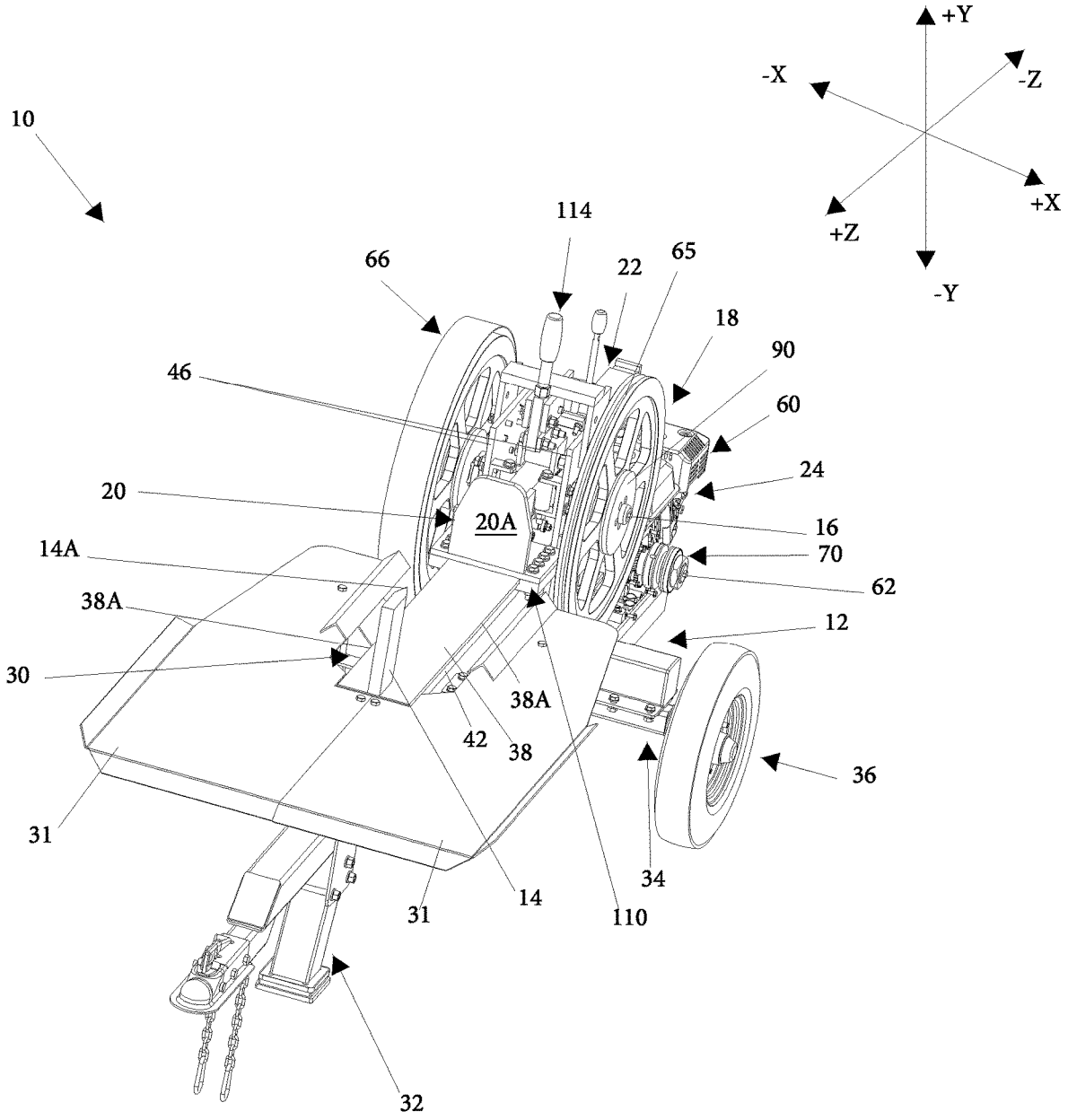
FIG. 1 schematically depicts a perspective view of a kinetic log splitter having an automatic braking mechanism according to one or more embodiments shown or described herein.

Kinetic log splitters according to the present specification include a frame, a splitter, a gear shaft, a drive assembly, a push plate, a rack, and an automatic brake mechanism. The splitter is coupled to the frame. The gear shaft is rotatably coupled to the frame. The drive assembly configured to rotate the gear shaft. The push plate is slidably coupled to the frame. The rack is operatively coupled to the push plate. The rack is configured to engage with the gear shaft to linearly displace the push plate towards the splitter. The automatic brake mechanism is configured to automatically inhibit rotation of the gear shaft by the drive assembly upon exceeding a predetermined tonnage on the push plate The kinetic log splitters of the present disclosure inhibit the continued rotation of the gear shaft by the drive assembly when the linear displacement of the push plate and the rack is obstructed. Specifically, the automatic brake mechanism is configured to inhibit (i.e. reduce and/or stop) transmission of a rotational force from the drive assembly to the gear shaft upon exceeding a predetermined tonnage and/or force on the push plate. The automatic inhibiting of the transmission of rotational force to the gear shaft when the linear displacement of the rack is obstructed prevents wear and damage to the gear shaft and the rack, specifically, damage to gear teeth of the gear shaft due to a shock stress.

Various embodiments of kinetic log splitter are described in detail below with reference to the appended drawings.

As used herein, the term "longitudinal direction" refers to the forward-rearward direction of the log splitter (i.e., in the +/−Z-direction as depicted). The term "lateral direction" refers to the cross-vehicle direction of the log splitter (i.e., in the +/−X-direction as depicted), and is transverse to the longitudinal direction. The term "vertical direction" refers to the upward-downward direction of the log splitter (i.e., in the +/−Y-direction as depicted). As used herein, "upper" and "above" are defined as the positive Y direction of the coordinate axis shown in the drawings. "Lower" and "below" are defined as the negative Y direction of the coordinate axis shown in the drawings. Further, the terms "outboard" as used herein refers to the relative location of a component with respect to a centerline. The term "inboard" as used herein refers to the relative location of a component with respect to the centerline. Because the log splitter structures may be generally symmetrical about the centerline, the direction to which use of terms "inboard" or "outboard" and refer may be mirrored about the centerline when evaluating components positioned along opposite sides.

Referring to FIG. 1, a log splitter is generally illustrated at 10. The log splitter 10 is a kinetic log splitter that stores kinetic energy and operates to release the stored kinetic energy to split logs. The log splitter 10 includes a frame 12, a splitter 14, a gear shaft 16, a drive assembly 18, a push plate 20, a rack 22, and an automatic brake mechanism 24.

Figure 4:
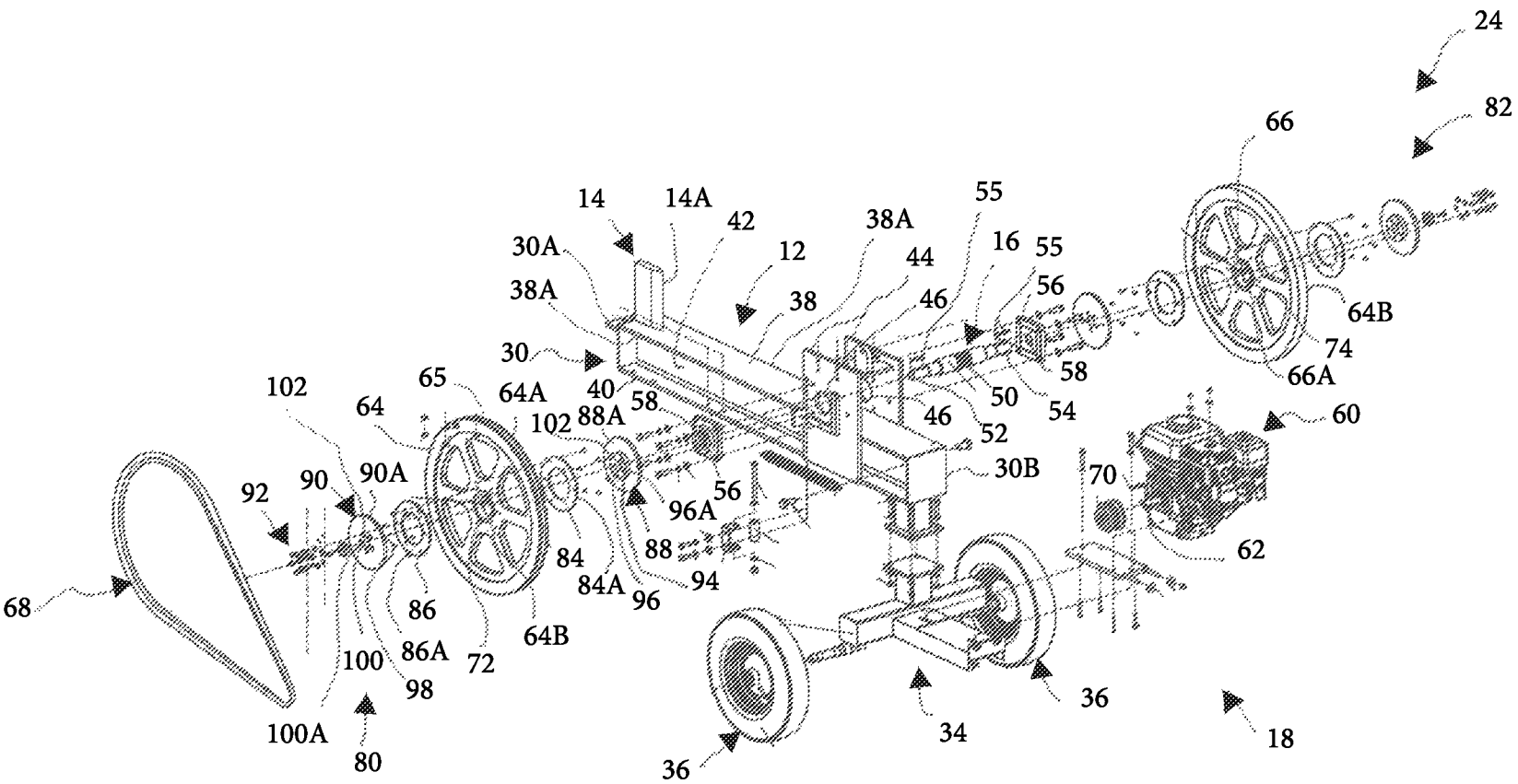
FIG. 4 schematically depicts a partial exploded perspective view of the automatic brake mechanism of FIG. 1, according to one or more embodiments shown or described herein.

Referring to FIGS. 1 and 4, the frame 12 includes an elongated frame member 30, a pair of tables 31, a front strut 32, a rear strut 34, and a pair of wheel 36 rotatably coupled to the rear strut 34. The frame member 30 includes a front end 30A and an opposite a rear end 30B. The pair of tables 31 are secured to the frame member 30. The front strut 32 is positioned adjacent the front end 30A of the frame member 30. The rear strut 34 is positioned adjacent the rear end 30B of the frame member 30. The frame member 30 includes a top wall 38, a bottom wall 40, and a side wall 42 that extends between the top wall 38 and the bottom wall 40, such that the frame member 30 has a generally I-shaped cross-sectional shape. The top wall 38 includes a pair of side edges 38A that are spaced apart from the side wall 42. A pair of flanges 46 extend upwardly from the frame member 30. Each of the pair of flanges 46 includes an opening 48.

The splitter 14 is fixedly secured to the frame member 30. The splitter 14 extends upwardly in the vertical direction from the top wall 38 of the frame member 30. The splitter 14 is positioned adjacent the front end 30A of the frame member 30. The splitter 14 is formed as a wedge that tapers rearwardly in the longitudinal direction to an edge 14A. The edge 14A of the splitter 14 faces the rear end 30B of the frame member 30.

The gear shaft 16 is rotatably coupled to the frame 12. The gear shaft 16 includes a plurality of gear teeth 50 disposed between a first end 52 and a second end 54. The first end 52 and the second end 54 each include a shaped key 55. The gear shaft 16 is received in the openings 48 of the pair of flanges 46 such that the plurality of gear teeth 50 of the gear shaft 16 is positioned between the pair of flanges 46, and the first end 52 and the second end 54 extend outwardly through the openings 48 of the pair of flanges 46. Each of the pair of flanges 46 includes a bearing 56 having an opening 58 on an outer surface thereof. The bearings 56 are mounted to the outer surface of the pair of flanges 46 by a plurality of fasteners. The first end 52 and the second end 54 of the gear shaft 16 extend through the openings 58 of the bearings 56 such that the gear shaft 16 is configured to rotate with respect to the pair of flanges 46.

The drive assembly 18 is configured to supply a rotational force to rotate the gear shaft 16. The drive assembly 18 includes a motor 60 having an output shaft 62, a first flywheel 64, a second flywheel 66, and a drive belt 68. The motor 60, such as an internal combustion engine or an electric motor, outputs a rotational force to the output shaft 62. The motor 60 is mounted to the rear strut 34 of the frame 12. In some embodiments, a clutch 70 is optionally provided on the output shaft 62. The clutch 70 may be configured to operate as a gear reducer to reduce a torque and/or a rotational speed of the output shaft 62 to a preset torque and/or a preset rotational speed.

The drive belt 68 couples the output shaft 62 of the motor 60 to the first flywheel 64 such that rotation of the output shaft 62 rotates the first flywheel 64. In some embodiments, the drive belt 68 engages with the clutch 70 and the first flywheel 64. The first flywheel 64 and the second flywheel 66 are operatively coupled to the gear shaft 16 by the automatic brake mechanism 24 such that the automatic brake mechanism 24 is configured to transmit a rotational force of the first flywheel 64 to the gear shaft 16. As such, the first flywheel 64 is configured to transmit rotational force from the output shaft 62 of the motor 60 to the gear shaft 16 through the automatic brake mechanism 24.

The first flywheel 64 includes an inner surface 64A, an opposite outer surface 64B, and a central opening 72 that extends between the inner surface 65A and the outer surface 65B. The second flywheel 66 includes an inner surface 66A, an opposite outer surface 66B, and a central opening 74 that extends between the inner surface 66A and the outer surface 66B. In some embodiments, the first flywheel 64 includes a groove 65 provided on an outer peripheral surface, the groove 65 engages with the drive belt 68.

As will be described in greater detail below, the automatic brake mechanism 24 is configured to automatically inhibit rotation of the gear shaft 16 by the drive assembly 18 upon exceeding a predetermined force on the push plate 20. Specifically, the automatic brake mechanism 24 is configured to inhibit the transmission of rotational force from the first flywheel 64 to the gear shaft 16.

The automatic brake mechanism 24 includes a first slip disk assembly 80 and a second slip disk assembly 82. The first slip disk assembly 80 operatively couples the first flywheel 64 to the gear shaft 16, specifically the first end 52 of the gear shaft 16. The second slip disk assembly 82 operatively couples the second flywheel 66 to the gear shaft 16, specifically the second end 54 of the gear shaft 16. The first slip disk assembly 80 and the second slip disk assembly 82 are moveable between an engaged position and a disengaged position. In the engaged position, the first slip disk assembly 80 and the second slip disk assembly 82 are configured to permit the transmission of rotational force from the first flywheel 64 and the second flywheel 66, respectively, to the gear shaft 16. In the disengaged position, the first slip disk assembly 80 and the second slip disk assembly 82 are configured to inhibit the transmission of rotational force from the first flywheel 64 and the second flywheel 66, respectively, to the gear shaft 16.

As the second slip disk assembly 82 is provided with a corresponding structure of the first slip disk assembly 80, and as operation of the second slip disk assembly 82 corresponds to the operation of the first slip disk assembly 80, discussion of the second slip disk assembly 82 will be omitted.

The first slip disk assembly 80 includes an inner friction plate 84, an outer friction plate 86, an inner rotor 88, an outer rotor 90, and a plurality of first fasteners 92. The inner friction plate 84 is mounted to the inner surface 64A of the first flywheel 64. The inner friction plate 84 includes a friction surface 84A opposite the inner surface 64A of the first flywheel 64. The outer friction plate 86 is mounted to the outer surface 64B of the first flywheel 64. The outer friction plate 86 includes a friction surface 86A opposite the outer surface 64B of the first flywheel 64.

The inner rotor 88 includes a central hub 94 that extends outwardly from a rotor surface 88A of the inner rotor 88. An opening 96 extends through the central hub 94 of the inner rotor 88. The opening 96 includes a keyed slot 96A that corresponds to the shaped key 55 of the first end 52 of the gear shaft 16. The outer rotor 90 includes a central hub 98 that extends outwardly from a rotor surface 90A of the outer rotor 90. An opening 100 extends through the central hub 98 of the outer rotor 90. The opening 100 includes a keyed slot 100A that corresponds to the shaped key 55 of the first end 52 of the gear shaft 16. The engagement of the keyed slot 96A of the inner rotor 88 and the keyed slot 100A of the outer rotor 90 with the shaped key 55 of the first end 52 of the gear shaft 16 secures the inner rotor 88 and the outer rotor 90 to the gear shaft 16 such that rotation of the inner rotor 88 and the outer rotor 90 rotates the gear shaft 16.

The central bub 94 of the inner rotor 88 and central hub 98 of the outer rotor 90 include a plurality of corresponding bores 102. The central hub 94 of the inner rotor 88 and the central hub 98 of the outer rotor 90 are at least partially received within the opening 72 of the first flywheel 64. The inner rotor 88 and the outer rotor 90 are secured together by the plurality of fasteners 92 that extend through the corresponding bores 102 of the central bub 94 of the inner rotor 88 and central hub 98 of the outer rotor 90 such that the friction surface 84A of the inner friction plate 84 is in frictional engagement with the rotor surface 88A of the inner rotor 88 and the friction surface 86A of the outer friction plate 86 is in frictional engagement with the rotor surface 90A of the outer rotor 90.

As such, the first flywheel 64 is operatively coupled to the gear shaft 16 by the frictional engagement of the friction surface 84A of the inner friction plate 84 and the rotor surface 88A of the inner rotor 88, and the frictional engagement of the friction surface 86A of the outer friction plate 86 and the rotor surface 90A of the outer rotor 90. Specifically, the first flywheel 64 is configured to permit transmission of rotational force from motor 60 through the drive belt 68 and the output shaft 62 as long as the friction surface 84A of the inner friction plate 84 is in frictional engagement with the rotor surface 88A of the inner rotor 88 and the friction surface 86A of the outer friction plate 86 is in frictional engagement with the rotor surface 90A of the outer rotor 90. Specifically, the first flywheel 64 is only connected to the inner rotor 88 and the outer rotor 90 due to the frictional engagement between the friction surface 84A of the inner friction plate 84 and the rotor surface 88A of the inner rotor 88 and due to the frictional engagement between the friction surface 86A of the outer friction plate 86 and the rotor surface 90A of the outer rotor 90. Further, the first flywheel is not directly connected to the gear shaft 16, rather the inner rotor 88 and the outer rotor 90 are secured to the gear shaft 16 and the first flywheel 64 is connected to the inner rotor 88 and the outer rotor 90 by the frictional engagement between the friction surface 84A of the inner friction plate 84 and the rotor surface 88A of the inner rotor 88 and the frictional engagement between the friction surface 86A of the outer friction plate 86 and the rotor surface 90A of the outer rotor 90. Accordingly, upon exceeding the predetermined rotational force, the first flywheel 64 is configured to rotate relative to and/or with respect to the inner rotor 88 and the outer rotor 90 such that the first flywheel 64, when the first slip disk mechanism 80 is in the disengaged position, does not rotate with the gear shaft 16 (i.e. the rotation of the first flywheel 64 when in the first slip disk assembly 80 is in the disengaged position does not transmit a rotational force to the gear shaft 16 to rotate the gear shaft 16 as the first flywheel 64 is not directly connected to the gear shaft 16).

In the engaged position of the first slip disk assembly 80, the friction surface 84A of the inner friction plate 84 and the friction surface 86A of the outer friction plate 86 are frictionally engaged with the rotor surface 88A of the inner rotor 88 and the rotor surface 90A of the outer rotor 90, respectively. The first slip disk assembly 80 is in the engaged position when a rotational force between the friction surface 84A of the inner friction plate 84 and the rotor surface 88A of the inner rotor 88 and between the friction surface 86A of the outer friction plate 86 and the rotor surface 90A of the outer rotor 90 is less than a predetermined rotational force.

As used herein, the predetermined rotational force is a rotational force at which frictional engagement between the friction surface 84A of the inner friction plate 84 and the rotor surface 88A of the inner rotor 88 and the frictional engagement between the friction surface 86A of the outer friction plate 86 and the rotor surface 90A of the outer rotor 90 is not overcome. Specifically, at a rotational force less than the predetermined rotational force, the frictional engagement between the friction surface 84A and the rotor surface 88A and the frictional engagement between the friction surface 86A and the rotor surface 90A causes the rotation of the first flywheel 64 to be transmitted to the inner rotor 88 and the outer rotor 90, and the rotation of the inner rotor 88 and the outer rotor 90 rotates the gear shaft 16.

Upon exceeding the predetermined rotational force, the first slip disk assembly 80 moves from the engaged position to the disengaged position. In the disengaged position, the first flywheel 64 rotates with respect to the inner rotor 88 and the outer rotor 90 such that the first slip disk assembly 80 inhibits the transmission of rotational force from the drive assembly 18, specifically rotation of the first flywheel 64, to the gear shaft 16 through the inner rotor 88 and the outer rotor 90. Specifically, at a rotational force equal to or greater than the predetermined rotational force, the frictional engagement between the friction surface 84A and the rotor surface 88A and the frictional engagement between the friction surface 86A and the rotor surface 90A is overcome which inhibits the transmission of the rotation of the first flywheel 64 from being transmitted to the inner rotor 88 and the outer rotor 90, as the first flywheel 64 rotates with respect to the inner rotor 88 and the outer rotor 90 the gear shaft 16 is inhibited from being rotated. Accordingly, upon exceeding the predetermined rotational force between the first flywheel 64 and the inner rotor 88 and the outer rotor 90, the first flywheel 64 slips with respect to the inner rotor 88 and the outer rotor 90 such that there is a decrease in an amount of rotational force from the first flywheel 64 that is transmitted to the inner rotor 88 and the outer rotor 90 which decreases the rotational force of the gear shaft 16.

In some embodiments, the predetermined rotational force is set based on at least one of a friction between the friction surface 84A and the rotor surface 88A and a friction between the friction surface 86A and the rotor surface 90A, a tightening force of the plurality of fasteners 92 that secure the inner rotor 88 to the outer rotor 90, and a tension of the drive belt 68.

In some embodiments, the first slip disk assembly 80 includes five fasteners 92 which are tightened between a range of 5.16 to 5.9 foot pounds (ft-lb). In some embodiments, the drive belt 68 is tensioned so as to have a deflection of at least 3 centimeters (cm).

Figure 2:
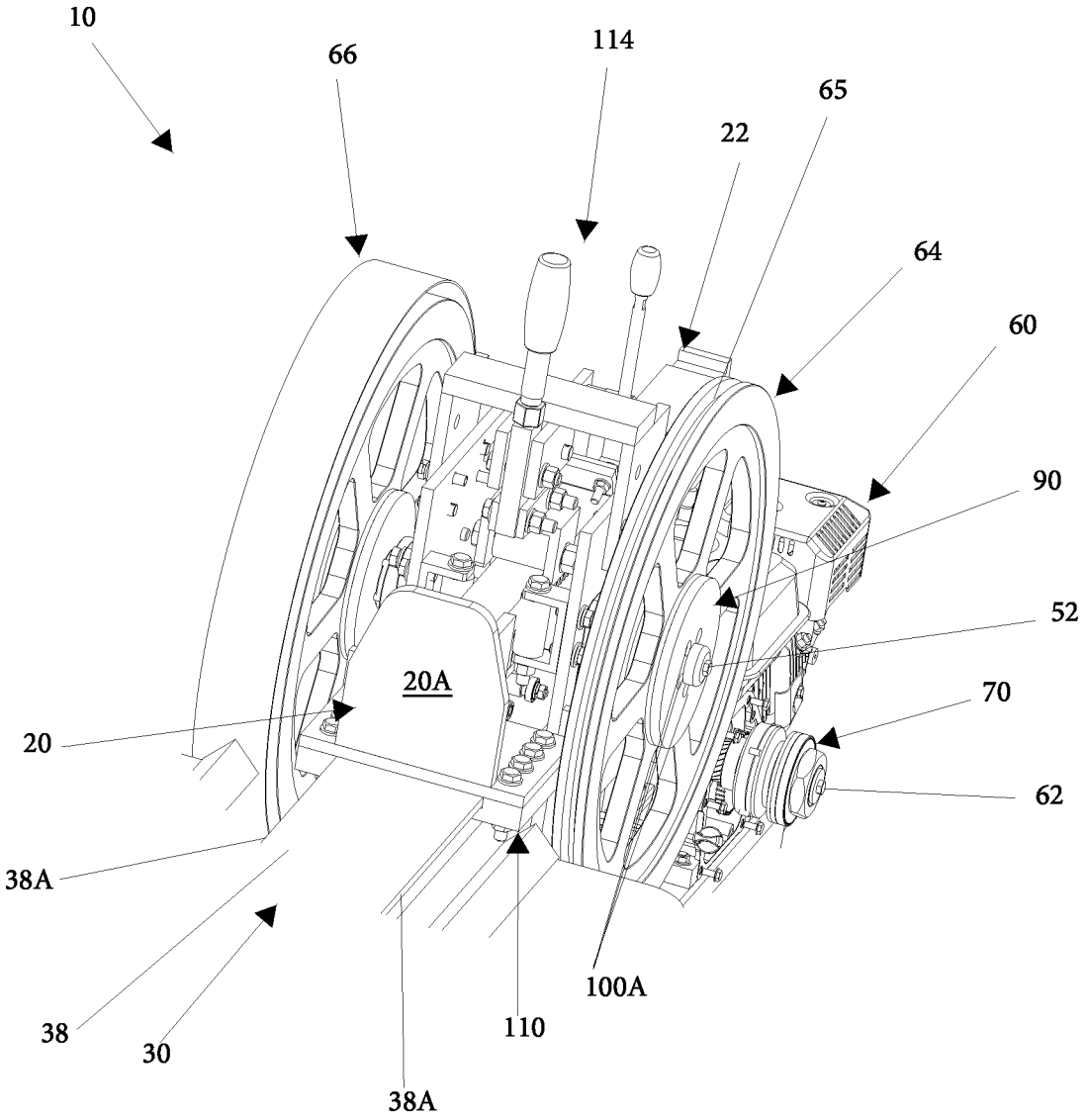
FIG. 2 schematically depicts a partial enlarged view of the kinetic log splitter having the automatic braking mechanism of FIG. 1 according to one or more embodiments shown or described herein.
Figure 3:
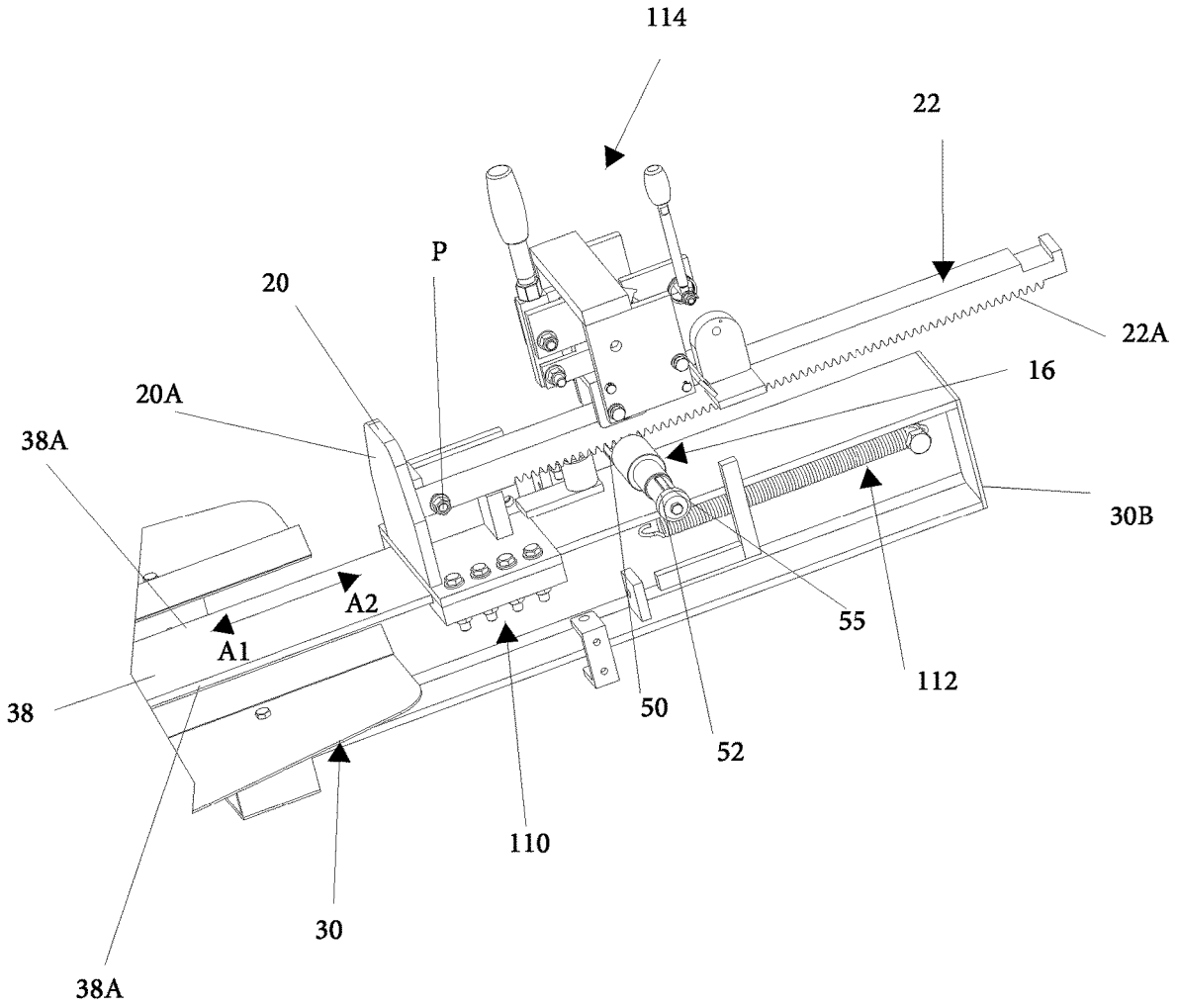
FIG. 3 schematically depicts a partial enlarged view of the kinetic log splitter of FIG. 1, according to one or more embodiments shown or described herein.

Referring to FIGS. 1-3, the push plate 20 includes a push surface 20A that faces the edge 14A of the splitter 14. The push plate 20 is coupled to a push seat 110 that slidably engages with the top wall 38 and the side edges 38A of the top wall 38 such that the push plate 20 is slidable with respect to the frame 12 in the direction of arrow A1 and A2. A biasing member 112, such as a spring, has one end connected to the push seat 110 and an opposite end connected to the frame member 30. The biasing member 112 biases the push plate 20 and the push seat 110 in the direction of arrow A2.

The rack 22 is pivotally coupled to the push plate 20 about a pivot axis P. The rack 22 includes a plurality of teeth 22A configured to engage with the gear teeth 50 of the gear shaft 16. An actuator assembly 114 is coupled to the rack 22 to pivot the rack 22 about the pivot axis P between a disengaged position and an engaged position. In the disengaged position, the plurality of teeth 22A of the rack 22 are spaced apart from gear teeth 50 of the gear shaft 16 such that upon rotation of the gear shaft 16, the rack 22 is not linearly displaced in the direction of arrow A1. In the engaged position, the plurality of teeth 22A of the rack 22 engages with the gear teeth 50 of the gear shaft 16 such that rotation of the gear shaft 16 linearly displaces the rack 22 and the push plate 20 forward in the direction of arrow A1 towards the edge 14A of the splitter 14.

In operation, a log (not shown) is placed on the top wall 38 of the frame member 30 between the edge 14A of the splitter 14 and the push surface 20A of the push plate 20. As the rack 22 is in the disengaged position, with the plurality of teeth 22A spaced apart from the gear teeth 50 of the gear shaft 16, the rack 22 is not linearly displaced forward in the direction of arrow A1 towards the edge 14A of the splitter 14. The drive assembly 18, specifically, the motor 60 outputs a rotational force from the output shaft 62 which is transmitted to the first flywheel 64 by the drive belt 68. The first slip disk assembly 80 and the second slip disk assembly 82 are in the engaged position such that the rotation of the first flywheel 64 is transmitted through the first slip disk assembly 80 to the gear shaft 16 which rotates the second flywheel 66 through the second slip disk assembly 82. As the first flywheel 64 and the second flywheel 66 rotate with the gear shaft 16, kinetic energy is stored in the first flywheel 64 and the second flywheel 66 due to the inertia of the first flywheel 64 and the second flywheel 66.

Upon actuation of the actuation assembly 114, the rack 22 is pivoted about the pivot axis P from the disengaged position to the engaged position. In the engaged position, the engagement of the gear teeth 50 of the gear shaft 16 with the plurality of teeth 22A of the rack 22 linearly displaces the push plate 20 forward in the direction of arrow A1 towards the edge 14A of the splitter 14 utilizing the stored kinetic energy from the rotation of the first flywheel 64 and the second flywheel 66. The rotation of the gear shaft 16 linearly displaces the rack 22 in the direction of arrow A1 from a retracted position to an extended position. The rack 22 and the push plate 20 are linearly displaced forward in the direction of arrow A1 at a predetermined pressure/tonnage and/or force to split the log placed between the edge 14A of the splitter 14 and the push surface 20A of the push plate 20.

In the extended position, the rack 22 is linearly displaced forward in the direction of arrow A1 such that the plurality of teeth 22A of the rack 22 are no longer engaged with the gear teeth 50 of the gear shaft 16. Upon reaching the extended position, the actuation assembly 114 pivots the rack 22 about the pivot axis P to the disengaged position and a biasing force of the biasing member 112 biases the rack 22 and the push plate 20 in the direction of arrow A2 from the extend position to the retracted position. It is appreciated, that during normal operation of linearly displacement of the rack 22 from the retracted position to the extended position, the automatic brake mechanism 24 permits transmission of rotational force from the first flywheel 64 to the gear shaft 16, specifically, the first slip disk assembly 80 and the second slip disk assembly 82 are maintained in the engaged position.

During operation in which the rack 22 is obstructed from linearly displacing from the retracted position into the extended position, for example, the rack 22 is stopped or jammed as a pressure/tonnage and/or force required to move the rack 22 to into the extended position exceeds the predetermined pressure/tonnage and/or force, the predetermined rotational force of the first slip disk assembly 80 and the second slip disk assembly 82 is exceeded such that the first slip disk assembly 80 and the second slip disk assembly 82 move from the engaged position to the disengaged position such that the transmission of rotational force from the first flywheel 64 and the second flywheel 66 to the gear shaft 16 in inhibited.

In some embodiments, the predetermined rotational force is set based on the predetermined pressure/tonnage and/or force, which is applied to the push plate 20 to prevent the linear displacement of the push plate 20 and the rack 22 in forward in the direction of arrow A1. Upon exceeding the predetermined pressure/tonnage and/or force applied to the push plate 20, the rotational force between the first flywheel 64 and the gear shaft 16, specifically the first slip disk assembly 80, and the rotational force between the second flywheel 66 and gear shaft 16, specifically the second slip disk assembly 82, exceeds the predetermined rotational force such that the first slip disk assembly 80 and the second slip disk assembly 82 moves from the engaged position to the disengaged position such that the first slip disk assembly 80 and the second slip disk assembly 82 inhibit the transmission of rotational force from the first flywheel 64 and the second flywheel 66, respectively, to the gear shaft 16.

When the rack 22, in the engaged position with the plurality of teeth 22A are engaged with the gear teeth 50 of the gear shaft 16 such that rotation of the gear shaft 16 linearly displaces the rack 22 forward in the direction of arrow A1, is obstructed (i.e. jammed or stopped) from linearly displacing forward in the direction of arrow A1 such that that the predetermined pressure/tonnage or force is exceeded, the rack 22 is unable to linearly displace forward in the direction of arrow A1. As such, a rotation force required to rotate the gear shaft 16 is increased such that the predetermined rotational force between the gear shaft 16 (i.e. inner rotor 88 and outer rotor 90) and the first flywheel 64 (i.e. the inner friction plate 84 and the outer friction plate 86) is exceeded which moves the first slip disk assembly 80 and the second slip disk assembly 82 from the engaged position to the disengaged position.

By inhibiting the transmission of rotational force from the first flywheel 64 and the second flywheel 66 to the gear shaft 16, the rotation force of the gear shaft 16 is thereby reduced to prevent excess wear and shock damage to the gear teeth 50 and the plurality of teeth 22A of the rack 22 due to the continued rotation of the gear shaft 16 as the gear teeth 50 are engaged with the plurality of teeth 22A of the rack 22 which is obstructed from linearly displacing forward in the direction of arrow A1.

In some embodiments, the predetermined pressure is 42 tonnage, ±1%, ±5%, or ±10%.

In some embodiments, the actuation assembly 114 is configured to pivot the rack 22 from the engaged position to the disengaged position upon movement of the first slip disk assembly 80 and the second slip disk assembly 82 moving from the engaged position to the disengaged position to return the rack 22 to the retracted position. Once the rotational force between the first flywheel 64 and the second flywheel 66 and the gear shaft 16 is less than the predetermined rotational force, the first slip disk assembly 80 and the second slip disk assembly 82 move from the disengaged position to the engaged position.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A kinetic log splitter comprising:

a frame;

a splitter coupled to the frame;

a gear shaft rotatably coupled to the frame;

a drive assembly configured to rotate the gear shaft;

a push plate slidably coupled to the frame;

a rack operatively coupled to the push plate, the rack configured to engage with the gear shaft to linearly displace the push plate towards the splitter; and an automatic brake mechanism configured to automatically inhibit rotation of the gear shaft by the drive assembly upon exceeding a predetermined tonnage on the push plat;

wherein the drive assembly includes a motor having an output shaft and a flywheel operatively coupled to the output shaft of the motor, the automatic brake mechanism operatively couples the flywheel to the gear shaft, the flywheel is configured to transmit rotational force from the output shaft to the gear shaft through the automatic brake mechanism.

2. The kinetic log splitter of claim 1, wherein the automatic brake mechanism includes a slip disk assembly that operatively couples the flywheel to the gear shaft, the slip disk assembly is moveable from an engaged position to a disengaged position upon exceeding the predetermined tonnage on the push plate, in the engaged position the slip disk assembly is configured to permit transmission of rotational force from the flywheel to the gear shaft, and in the disengaged position the slip disk assembly is configured to inhibit transmission of rotational force from the flywheel to the gear shaft.

3. The kinetic log splitter of claim 2, wherein the slip disk assembly includes an inner friction plate, an outer friction plate, an outer rotor having a rotor surface, and an inner rotor having a rotor surface, and wherein the inner friction plate is secured to an inner surface of the flywheel, the outer friction plate is secured to an outer surface of the flywheel, the rotor surface of the inner rotor contacts the inner friction plate, and the rotor surface of the outer rotor contacts the outer friction plate.

4. The kinetic log splitter of claim 3, wherein the inner rotor includes a central hub extending outwardly from the rotor surface of the inner rotor, and the outer rotor includes a central hub extending outwardly from the rotor surface of the outer rotor.

5. The kinetic log splitter of claim 4, wherein the central hub of the inner rotor and the central hub of the outer rotor each include a keyed slot, and the gear shaft includes a shaped key corresponding to the keyed slot of the central hub of the inner rotor and the keyed slot of the central hub of the outer rotor, and the keyed slot of the central hub of the inner rotor and the central hub of the outer rotor engages with the shaped key of the gear shaft to rotatably couple the inner rotor and the outer rotor to the gear shaft.

6. The kinetic log splitter of claim 5, wherein the flywheel includes a central opening, and the central hub of the inner rotor is at least partially received within the central opening of the flywheel, and the central hub of the outer rotor is at least partially received within the central opening of the flywheel.

7. The kinetic log splitter of claim 6, wherein in the engaged position the rotor surface of the inner rotor is in frictional engagement with the inner friction plate and the rotor surface of the outer rotor is in frictional engagement with the outer friction plate such that the rotation of the flywheel rotates the inner rotor and the outer rotor to rotate the gear shaft.

8. The kinetic log splitter of claim 7, wherein upon exceeding the predetermined tonnage to the push plate, the frictional engagement of the rotor surface of the inner rotor and the inner friction plate and the frictional engagement of the rotor surface of the outer rotor and the outer friction plate is overcome such that the flywheel rotates with respect to the inner rotor and the outer rotor to inhibit transmission of rotational force from the flywheel to the gear shaft.

9. The kinetic log splitter of claim 8, wherein the central hub of the inner rotor includes a plurality of bores and the central hub of the outer rotor includes a plurality of bores corresponding to the plurality of bores of the central hub of the inner rotor, and wherein a plurality of fasteners extend through the plurality of bores of the central hub of the inner rotor and the plurality of bores of the central hub of the outer rotor to secure the inner rotor to the outer rotor and frictionally engage the rotor surface of the inner rotor to the inner friction plate and frictionally engage the rotor surface of the outer rotor to the outer friction plate.

10. The kinetic log splitter of claim 9, wherein the plurality of fasteners are tightened between a range of 5.16 to 5.9 ft-lb.

11. The kinetic log splitter of claim 10, wherein the drive assembly includes a drive belt that operatively couples the output shaft of the motor to the flywheel, and wherein the drive belt is tensioned at a deflection of 3 cm.

12. The kinetic log splitter of claim 11, wherein the predetermined tonnage is 42 tonnage.

13. The kinetic log splitter of claim 12 further comprising an actuator assembly configured to move the rack between a disengaged position and an engaged position, in the disengaged position a plurality of teeth of the rack is spaced apart from gear teeth of the gear shaft, and in the engaged position the plurality of teeth of the rack engages with the gear teeth of the gear shaft such that the gear shaft rotates to linearly displaces the rack and the push plate forward towards the splitter.

14. The kinetic log splitter of claim 13, wherein the rack is pivotally coupled to the push plate about a pivot axis, and wherein upon actuation of the actuator assembly the rack is pivoted about the pivot axis from the disengaged position to the engaged position.

15. A kinetic log splitter comprising:

a frame;

a splitter coupled to the frame;

a gear shaft rotatably coupled to the frame;

a motor configured to rotate an output shaft;

a flywheel coupled to the output shaft of the motor;

a push plate slidably coupled to the frame;

a rack operatively coupled to the push plate, the rack configured to engage with the gear shaft to linearly displace the push plate towards the splitter; and a slip disk assembly configured to operatively couple the flywheel to the gear shaft, the slip disk assembly being moveable between an engaged position and a disengaged position, in the engaged position the slip disk assembly permits transmission of rotational force from the flywheel to the gear shaft, in the disengaged position the slip disk assembly is configured to automatically inhibit transmission of rotational force from the flywheel to the gear shaft, the slip disk assembly configured to move from the engaged position to the disengaged position upon exceeding a predetermined rotational force between the flywheel and the slip disk assembly.

16. The kinetic log splitter of claim 15 further comprising a drive belt that couples the output shaft to the flywheel, wherein upon exceeding the predetermined rotational force the slip disk assembly inhibits the transmission of rotational force from the flywheel to the gear shaft by permitting the flywheel to rotate relative to the gear shaft.

17. The kinetic log splitter of claim 16, wherein the slip disk assembly includes an inner friction plate, an outer friction plate, an outer rotor having a rotor surface, and an inner rotor having a rotor surface, wherein the inner friction plate is secured to an inner surface of the flywheel, the outer friction plate is secured to an outer surface of the flywheel, the rotor surface of the inner rotor contacts the inner friction plate, and the rotor surface of the outer rotor contacts the outer friction plate, and the gear shaft is coupled to the inner rotor and the outer rotor such that rotation of the inner rotor and the outer rotor rotates the gear shaft.

18. The kinetic log splitter of claim 17, wherein in the engaged position a frictional engagement between the inner friction plate and the rotor surface of the inner rotor and a frictional engagement between the outer friction plate and the rotor surface of the outer rotor permits the rotation of the flywheel to rotate the inner rotor and the outer rotor which rotates the gear shaft, and in the disengaged position the exceeding of the predetermined rotational force overcomes the frictional engagement between the inner friction plate and the rotor surface of the inner rotor and the frictional engagement between the outer friction plate and the rotor surface of the outer rotor such that the flywheel rotates with respect to the inner rotor and the outer rotor.

19. The kinetic log splitter of claim 18, wherein the predetermined rotational force is exceeded when the rack is inhibited from linearly displacing the push plate and the rack is engaged with the gear shaft.

* * * * *